US005885202A

United States Patent [19]

Ostkamp

[11] Patent Number: 5,885,202

[45] Date of Patent: Mar. 23, 1999

[54] SOLID-BOWL CENTRIFUGE WITH CONTINUOUSLY VARIABLE LIQUID LEVEL

[75] Inventor: Willi Ostkamp, Oelde, Germany

[73] Assignee: Westfalia Separator Aktiengesellschaft, Oelde, Germany

[21] Appl. No.: 875,281

[22] PCT Filed: Oct. 16, 1995

[86] PCT No.: PCT/EP95/04054

§ 371 Date: Jun. 30, 1997

§ 102(e) Date: Jun. 30, 1997

[87] PCT Pub. No.: WO96/21510

PCT Pub. Date: Jul. 18, 1996

[30] Foreign Application Priority Data

Jan. 11, 1995 [DE] Germany ..... 195 00 600.3

[51] Int. Cl.[6] ..... B04B 11/06; B04B 11/08

[52] U.S. Cl. ..... 494/25; 494/56

[58] Field of Search ..... 494/1, 2, 3, 23, 494/25, 26, 38, 43, 56, 68–70, 85

[56] References Cited

U.S. PATENT DOCUMENTS

| | | | |
|---|---|---|---|
| 3,179,334 | 4/1965 | Sharples | 494/56 X |
| 4,417,885 | 11/1983 | Kohlstette et al. | 494/23 |
| 4,615,690 | 10/1986 | Ecker | 494/56 |
| 5,167,609 | 12/1992 | Graw et al. | 494/23 |
| 5,244,451 | 9/1993 | Retter | 494/25 X |

FOREIGN PATENT DOCUMENTS

| | | |
|---|---|---|
| 3728901 | 11/1988 | Germany . |
| 4126565 | 11/1992 | Germany . |

*Primary Examiner*—Charles E. Cooley

*Attorney, Agent, or Firm*—Sprung Kramer Schaefer & Briscoe

[57] ABSTRACT

A solid-bowl centrifuge has a rotatable drum having an interior and a space adjacent to the interior of the drum for receiving separated off liquid conveyed from the drum. A weir disk is disposed between the interior of the drum and the chamber and is rotatable with the drum. Liquid is conveyed past an inner diameter of the weir disk to the space and that determines a level of the liquid in the interior of the drum. Two barrier disks on opposite sides of flat surfaces of the weir disk are gas-tightly joined together by a cylinder extending through the inner diameter of the weir disk. One barrier disk is immersible in the liquid in the interior of the drum and the other barrier disk is immersible in the liquid in the space. The barrier disks and cylinder define a chamber and a gas-supply channel supplies gas to the chamber to vary the pressure therein and thereby vary the level of the liquid in the interior of the drum.

10 Claims, 2 Drawing Sheets

SOLID-BOWL CENTRIFUGE WITH CONTINUOUSLY VARIABLE LIQUID LEVEL

BACKGROUND OF THE INVENTION

The present invention concerns a solid-bowl centrifuge with a drum for separating a mixture of solids and liquid. There is a weir disk between the interior of the drum and a space for conveying the separated liquid off. The weir disk rotates along with the drum, and the inner diameter of the level of the liquid in the interior of the drum depends on the diameter of the weir disk.

A centrifuge of this type is known from German 3 728 901 C1 for example. Since the device that extracts the separated solids is conventionally designed to prevent liquid from flowing off over it, the separated liquid can leave only by way of the inside diameter of the weir disk, which diameter accordingly dictates the level of the liquid in the interior of the drum. The weir in the known centrifuge comprises two disks of different diameter with a gap between them. The weir disks can be actuated as desired by a hydraulically powered slide, creating two different levels of liquid in the drum. The level of liquid cannot be varied continuously, and the design is relatively complicated.

SUMMARY OF THE INVENTION

The object of the present invention is a simpler centrifuge drum that will allow the level of liquid in the interior of the drum to be varied continuously.

This object is attained in accordance with the present invention in that barrier disks are associated with both flat surfaces of the weir disk and joined together gas-tight by a cylinder that extends through the inside diameter of the weir disk, whereby the first barrier disk is immersed in the liquid in the interior of the drum and the second in the liquid in the space for conveying liquid off, whereby chamber is left between the barrier disks that can be charged to different pressures with gas from a gas-supply channel. The level of liquid in the interior of the drum can accordingly be varied continuously.

As long as atmospheric pressure prevails in the pressure-charged chamber, the level of the liquid in the interior of the drum will correspond to the inside diameter of the weir disk. When the chamber is charged, the pressure will be transmitted to the liquid between the two weir disks. To compensate for the increase, the level of the liquid in the interior of the drum will shaft radially inward until there is an equilibrium in pressure between the corresponding liquids. The level of the liquid in the interior of the drum can accordingly be displaced radially inward to a level d that corresponds to the compensation pressure, whereby no more liquid can escape by way of the solids-extraction device.

The barrier disks in one advantageous embodiment of the present invention are stationary. The pressure-charged chamber can accordingly be connected to the also stationary gas-supply channel with no need for a rotating gasket.

The second barrier disk in another advantageous embodiment acts as a peeler. This feature simplifies the design of centrifuges that employ peelers.

Both of the flat surfaces of the weir disk in another advantageous embodiment have ribs. This feature minimizes the braking action of the barrier disks, an action that diminishes the centrifugal force.

Another advantageous embodiment of the present invention is characterized in that the barrier disks rotate with the drum, by a liquid-filled sealing chamber on the radially inward side of the cylinder, whereby a gas-conveying channel opens into the sealing chamber radially inward of the liquid level, and by a stationary gas-supply facility with two radially outward-facing sealing disks that immerse themselves in the liquid in the sealing chamber on each side of the gas-conveying channel. The friction losses in this embodiment are very low due to the immersion of the sealing disks in the liquid because the diameter of the sealing disks is essentially shorter than that of the barrier disks. Since the barrier disks also rotate, accordingly, they will entail no friction losses.

All the flat surfaces of the sealing chamber that face the sealing disks in another advantageous embodiment have ribs. These ribs also minimize the braking action of the sealing disks that diminishes the centrifugal force.

A channel that supplies barrier fluid is associated with the sealing chamber in another advantageous embodiment. The incoming barrier fluid maintains the level of liquid in the sealing chamber.

A run-off channel is associated with the sealing chamber in another advantageous embodiment. The sealing chamber will accordingly evacuate when the sealing-liquid supply channel is closed. Friction losses can accordingly be eliminated when the level of liquid does not need to be regulated.

The sealing-liquid supply channel in another advantageous embodiment communicates with a liquid convey-off channel in the peeler. No special means of supplying barrier fluid is needed in this embodiment.

The level of liquid in the interior of the drum is simple to maintain at the desired height in another embodiment wherein the gas-supply channel communicates with a gas-supply line that accommodates pressure controls.

Embodiments of the present invention will now be specified by way of example with reference to the accompanying drawing, wherein

DETAILED DESCRIPTION OF THE INVENTION

Figure 1:
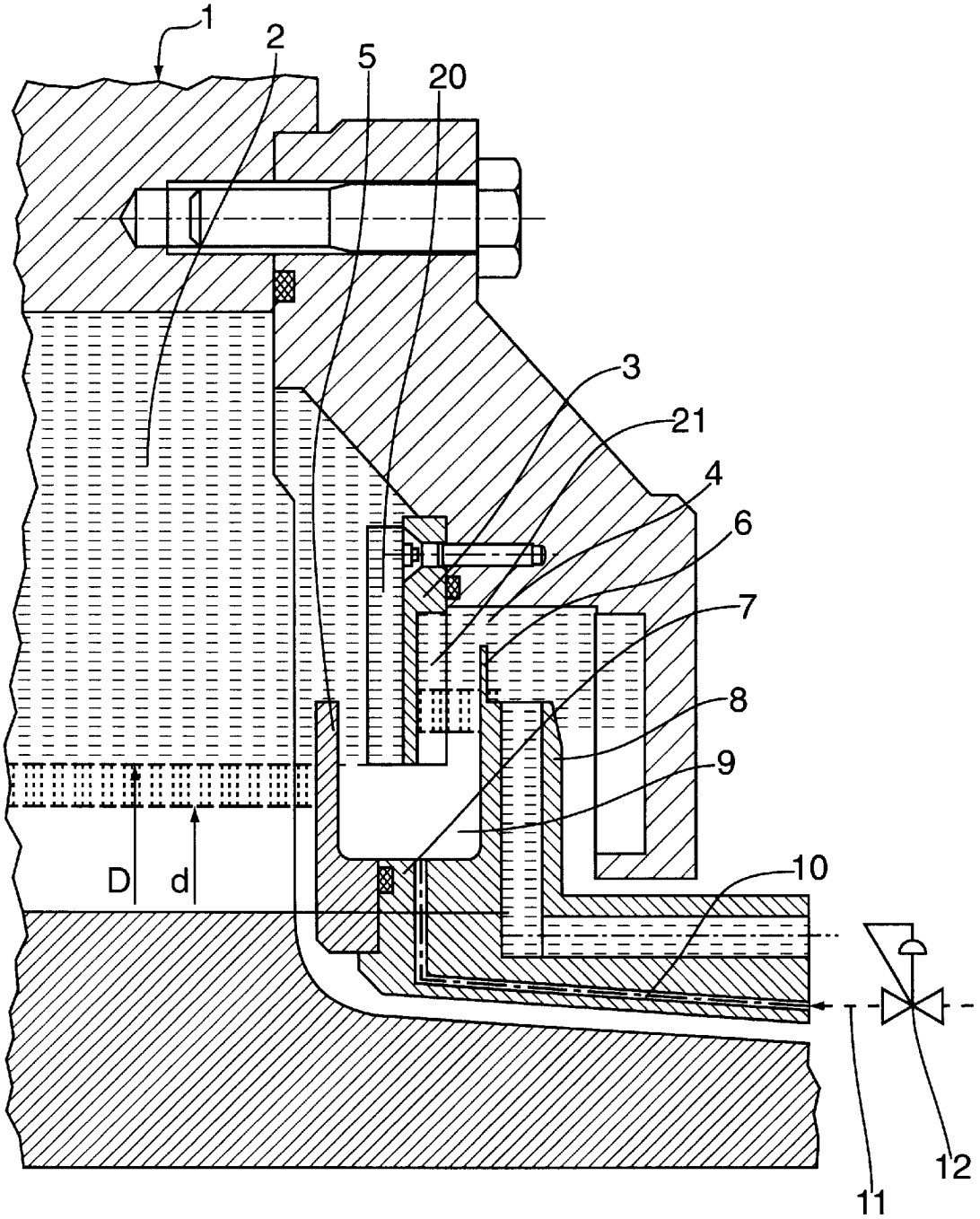
FIG. 1 illustrates a centrifuge drum with stationary barrier disks.

There is a weir disk 3 between the interior 2 of the drum 1 illustrated in FIG. 1 and a space 4 for conveying liquid off. Associated with the flat surfaces of weir disk 3 are two barrier disks 5 and 6. Barrier disks 5 and 6 are stationary and joined together gas-tight by a cylinder 7 that extends through the inside diameter of weir disk 3. First barrier disk 5 is immersed in the liquid in the interior 2 of drum 1 and second barrier disk 6 in the liquid in space 4. Second barrier disk 6 is mounted on a peeler 8. The chamber 9 between barrier disks 5 and 6 can be charged with gas from an unillustrated source by way of a gas-supply line 11 and gas-supply channel 10. Gas-supply line 11 accommodates pressure controls 12.

A lowest liquid level D, and accordingly the ideal range of settings, is established by the inside diameter of weir disk 3. The range of gas pressure can accordingly be narrower. To vary the level of liquid in the interior 2, chamber 9 is charged through gas-supply line 11 and gas-supply channel 10. The pressure is transmitted to the liquid in the vicinity of chamber 9. To compensate for the change in pressure, the level of liquid in interior 2 will shift radially in until a pressure equilibrium becomes established between the two liquids. The level of the liquid in interior 2 can accordingly be shifted to a level d that corresponds to the compensation pressure, whereupon no more liquid can emerge from the solids-extraction device. The pressure of the gas will accordingly be adjusted in accordance with the desired level of liquid and maintained there by pressure controls 12 even during fluctuations in the supply of liquid.

Figure 2:
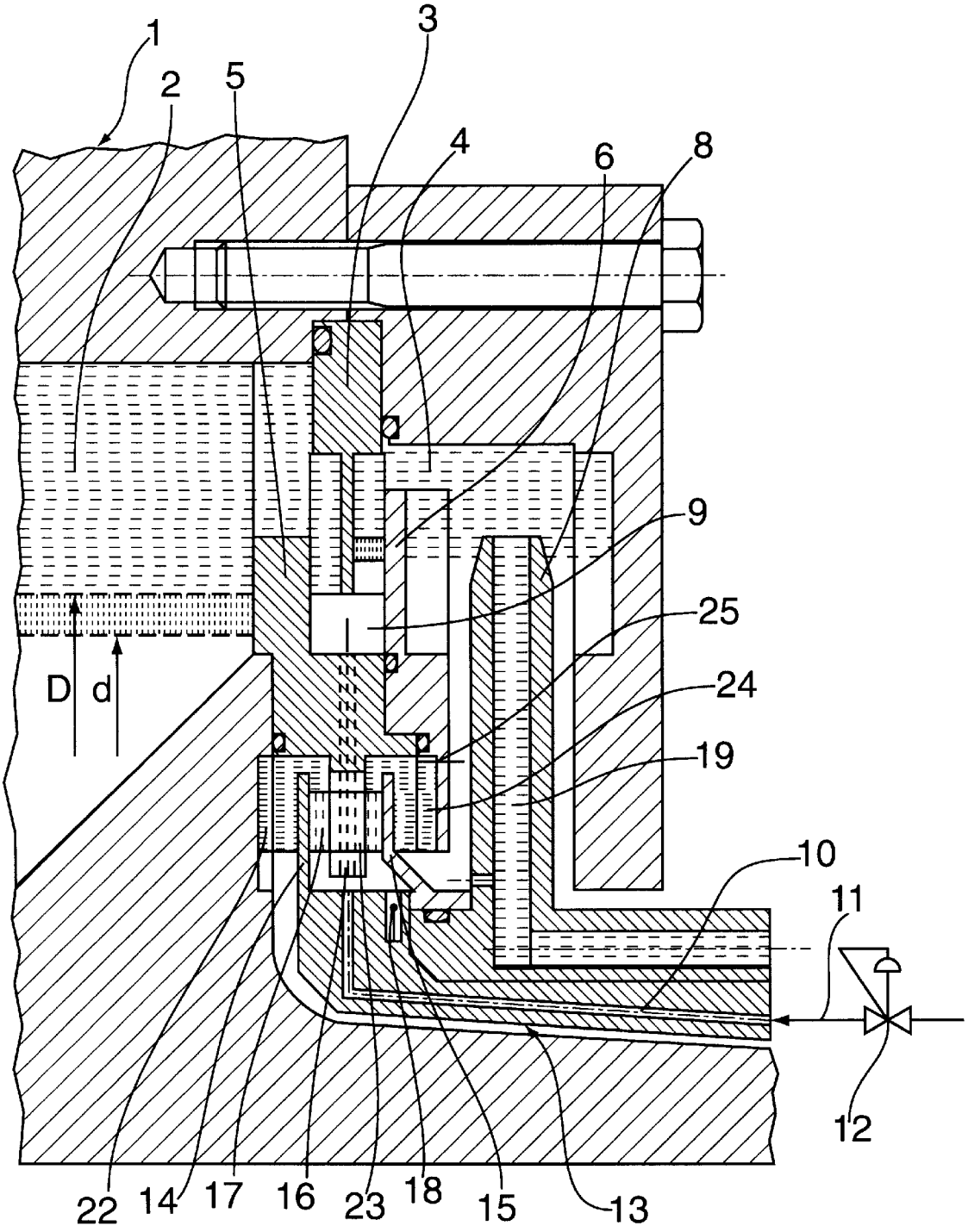
FIG. 2 illustrate a centrifuge drum with rotating barrier disks.

The barrier disks 5 and 6 in the embodiment illustrated in FIG. 2 rotate along with drum 1. There is accordingly no liquid friction between them and the liquid in interior 2 or in space 4. The pressure of the gas is transmitted to chamber 9 from gas-supply channel 10 by way of a gas-supply line 13 with three radially outward-facing sealing disks 14 and 15 that immerse themselves in the liquid in a sealing chamber 17. The pressure of the gas is transmitted to chamber 9 from a sealing chamber 17 through gas-conveying channel 16"; in this embodiment and results in so doing in a radial outward displacement of the level of liquid D in interior 2 due to the aforesaid action. Since sealing disks 14 and 15 extend over an essentially shorter diameter than barrier disks 5 and 6 do, the friction losses will be essentially lower than in the embodiment illustrated in FIG. 1. Sealing liquid in the form of a little of the liquid phase that has been conveyed off is constantly supplied to sealing chamber 17 through a supply channel 18, which can communicate with a liquid convey-off channel 19 in peeler 8.

To minimize the centrifugal-force diminishing braking action, the flat surfaces of weir disk 3 are provided with ribs 20 and 21 in FIG. 1 and all the flat surfaces that face sealing disks 14 and 15 are provided with ribs 22, 23, and 24 in FIG. 2.

Sealing chamber 17 can also be provided with a run-off channel 25 that it can empty through while the supply channel 18 is closed. When it is unnecessary to regulate the level of the liquid, friction losses can be minimized by emptying sealing chamber 17.

I claim:

1. A solid-bowl centrifuge comprising: a rotatable drum having an interior receptive of a mixture of solids and liquid; a space adjacent to the interior of the drum for receiving separated off liquid conveyed from the drum; a weir disk disposed between the interior of the drum and the space and rotatable with the drum wherein the weir disk has opposing flat surfaces and an inner diameter by which liquid is conveyed to the space and that thereby determines a level of the liquid in the interior of the drum; two barrier disks on opposite sides of the flat surfaces of the weir disk and gas-tightly joined together by a cylinder extending through the inner diameter of the weir disk, wherein one barrier disk is immersible in the liquid in the interior of the drum and the other barrier disk is immersible in the liquid in the space and wherein the barrier disks and cylinder define a chamber therebetween; and a gas-supply channel for supplying gas to the chamber to vary the pressure therein and thereby vary the level of the liquid in the interior of the drum.

2. The centrifuge according to claim 1, wherein the barrier disks are stationary.

3. The centrifuge according to claim 1 or 2, wherein the other barrier disk acts as a peeler.

4. The centrifuge according to claim 1, wherein the flat surfaces of the weir disk have ribs.

5. The centrifuge according to claim 1, wherein the barrier disks rotate with the drum and the cylinder has a radially inward side and further comprising a liquid-fillable sealing chamber at the radially inward side of the cylinder, wherein the gas-supply channel has a gas-conveying channel opening into the sealing chamber radially inward of the liquid level therein and wherein the gas-supply channel is stationary and has two radially outward facing sealing disks immersible in liquid in the sealing chamber on each side of the gas-conveying channel.

6. The centrifuge according to claim 5, wherein the sealing chamber has flat surfaces facing the sealing disks and wherein the flat surfaces of the sealing chamber have ribs.

7. The centrifuge according to claim 5 or 6, wherein the sealing chamber has a channel for supplying sealing liquid thereto.

8. The centrifuge according to claim 7, wherein the channel for supplying sealing liquid communicates with a liquid convey-off channel in a peeler.

9. The centrifuge according to claim 5, further comprising a run-off channel in communication with the sealing chamber.

10. The centrifuge according to claim 1, further comprising a gas supply line in communication with the gas-supply channel and having pressure controls.

* * * * *